In the budding medium, clusters of buds will form at the primary needle axils. Typically from 50 to 160 buds will form on a 4-cm long shoot during the four to six weeks residence in this medium.

Upon removal from the budding medium the shoots are cut into short sections at the internodes. These sections are then placed on Shoot Elongation Medium-II in 100×25 mm sealed dishes for a time usually about six to eight weeks. It has been found helpful to include activated charcoal in this medium to absorb toxic metabolites of the growing tissue. Each bud will elongate into a juvenile-like shoot from 1–2 cm in overall length. These shoots are then cut individually from the mass and placed base down in the auxin-containing Root Induction Medium of Tables II and III. This step is conveniently carried out in 90×95 mm culture jars.

In about four weeks from 1 to 4 short roots will have formed on the shoots. These roots are normally unbranched so the new plantlets are not yet well equipped to be thrust into a hostile outside environment. While they may be planted at this time, considerably higher survival can be achieved if the plantlets are placed in a Root Growth Medium, such as that described in Tables II and III. This is contained in the same size jars as above. Normally two to four weeks in this medium will be adequate to give the plantlet a healthy root system to better insure its future vigor.

Finally, the plantlets are placed in soil or preferably in a 1:3:1 perlite:peat:vermiculite potting mixture. They may initially be held on a mist bench for several weeks and then they are allowed to harden somewhat before being outplanted as plantlings.

EXAMPLE II

The procedure of the previous example was carried out using coast redwood (*Sequoia sempervirens*) of at least 10 years age as the donor tree. This was sprayed as before with the 200 mg/L BA solutions at weekly intervals and under the same conditions of dormancy, temperature, and photoperiod as was the *Pinus taeda*. After three to four weeks, budding was evident at the needle axils and these buds soon gave way to short juvenile-appearing shoots about 3 cm long. Procedures from this point were carried out similarly to those described in Example 1 except as noted below. The extended period after the last hormone spray and before the explants were taken from the donor tree was not felt to be necessary and the shoots were removed about six weeks after the initial cytokinin spray. Compositions of the media used are given in Tables IV and V.

TABLE IV

Salt Concentrations in *Sequoia sempervirons* Culture Media[1]

| Compound | Shoot Elongation Medium-I | Bud Induction Medium-I | Bud Induction Medium-II | Shoot Elongation Medium-II | Root Induction Medium | Root Growth Medium |
|---|---|---|---|---|---|---|
| $NH_4H_2PO_4$ | — | 300 | — | 300 | — | — |
| $NH_4NO_3$ | 825 | — | 1650 | — | — | 550 |
| $KNO_3$ | 950 | 2500 | 1900 | 2500 | 187.5 | 633.3 |
| $Ca(NO_3)_2.4H_2O$ | 220 | — | — | — | 152 | — |
| $CaCl_2.2H_2O$ | — | 200 | 440 | 200 | — | 146.6 |
| $NaH_2PO_4.H_2O$ | — | — | — | — | 138 | — |
| $KH_2PO_4$ | 85 | — | 170 | — | — | 56.6 |
| $MgSO_4.7H_2O$ | 400 | 400 | 400 | 400 | 200 | 133.3 |
| $MnSO_4.H_2O$ | 10 | 10 | 10 | 10 | 5 | 3.3 |
| $ZnSO_4.H_2O$ | 1 | 1 | 1 | 1 | 0.5 | 0.33 |
| $CuSO_4.H_2O$ | 0.2 | 0.2 | 0.2 | 0.2 | 0.1 | 0.066 |
| $Na_2EDTA$ | 37.3 | 37.3 | 37.3 | 37.3 | 37.3 | 37.3 |
| $FeSO_4.7H_2O$ | 27.8 | 27.8 | 27.8 | 27.8 | 27.8 | 27.8 |
| $H_3BO_3$ | 5 | 5 | 5 | 5 | 5 | 5 |
| KI | 1 | 0.5 | 1 | 1 | 1 | 1 |
| $NaMoO_4.2H_2O$ | 0.1 | 0.01 | 0.1 | 0.1 | 0.1 | 0.1 |
| $CoCl_2.6H_2O$ | 0.1 | 0.01 | 0.1 | 0.1 | 0.1 | 0.1 |

[1]mg/L of salt in medium

TABLE V

Vitamins, Hormones, and Other Nutrients in *Sequoia sempervirons* Culture Media[1]

| Compound | Shoot Elongation Medium-I | Bud Induction Medium-I | Bud Induction Medium-II | Root Induction Medium | Root Growth Medium |
|---|---|---|---|---|---|
| Myo-inosotol | 250 | 1,000 | 250 | 100 | 250 |
| Thiamine.HCl | 5 | 5 | 5 | 5 | 5 |
| Nicotinic Acid | 5 | 5 | 5 | 5 | 5 |
| Pyridoxine.HCl | 0.5 | 0.5 | 0.5 | 0.5 | 0.5 |
| L-Glutamine | — | 200 | — | 100 | — |
| L-Asparganine | — | — | — | 100 | — |
| Sucrose | 30,000 | 30,000 | 30,000 | 15,000 | 30,000 |
| Agar | 4,000 | 4,000 | 4,000 | 4,000 | 4,000 |
| $N^6$benzylamiopurine | 1.1 | — | — | — | — |
| Indole-3-acetic acid | 1 | — | — | — | — |
| Indole-3-butyric acid | 1 | — | 1 | 3 | — |
| α-Naphthalene acetic acid | — | — | 1 | 0.01 | — |
| Activated charcoal[2] | — | 10,000 | — | — | — |

[1]mg/L of compound in medium
[2]HCl washed

Because of the vigor of the shoots, an initial period in Shoot Elongation Medium was not necessary and they were placed directly in the first Bud Induction Medium of Tables IV and V. This medium contains both a cyto- 1
9
16
14
19
17
23
19
26a
43
44
39
41
27
29
42
26b
54
52
51
56
52
4
31
32
38
34
36
37
6
3

26a
72
42
27
29
54
54

74
51
54
54
73

68
67
32
42

69
32
42

42
39
71
32

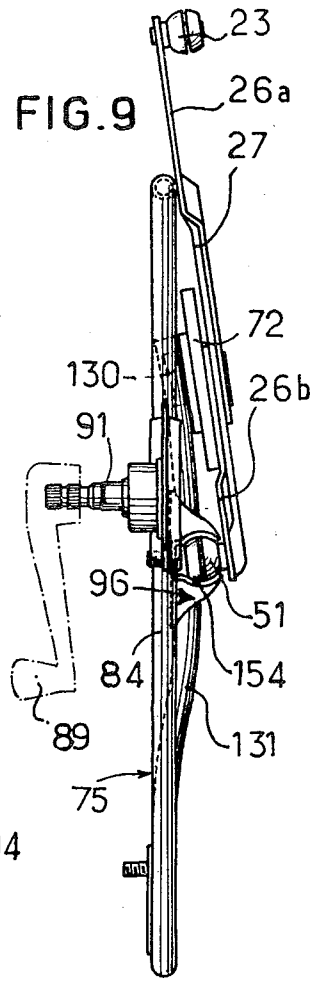
FIG. 9
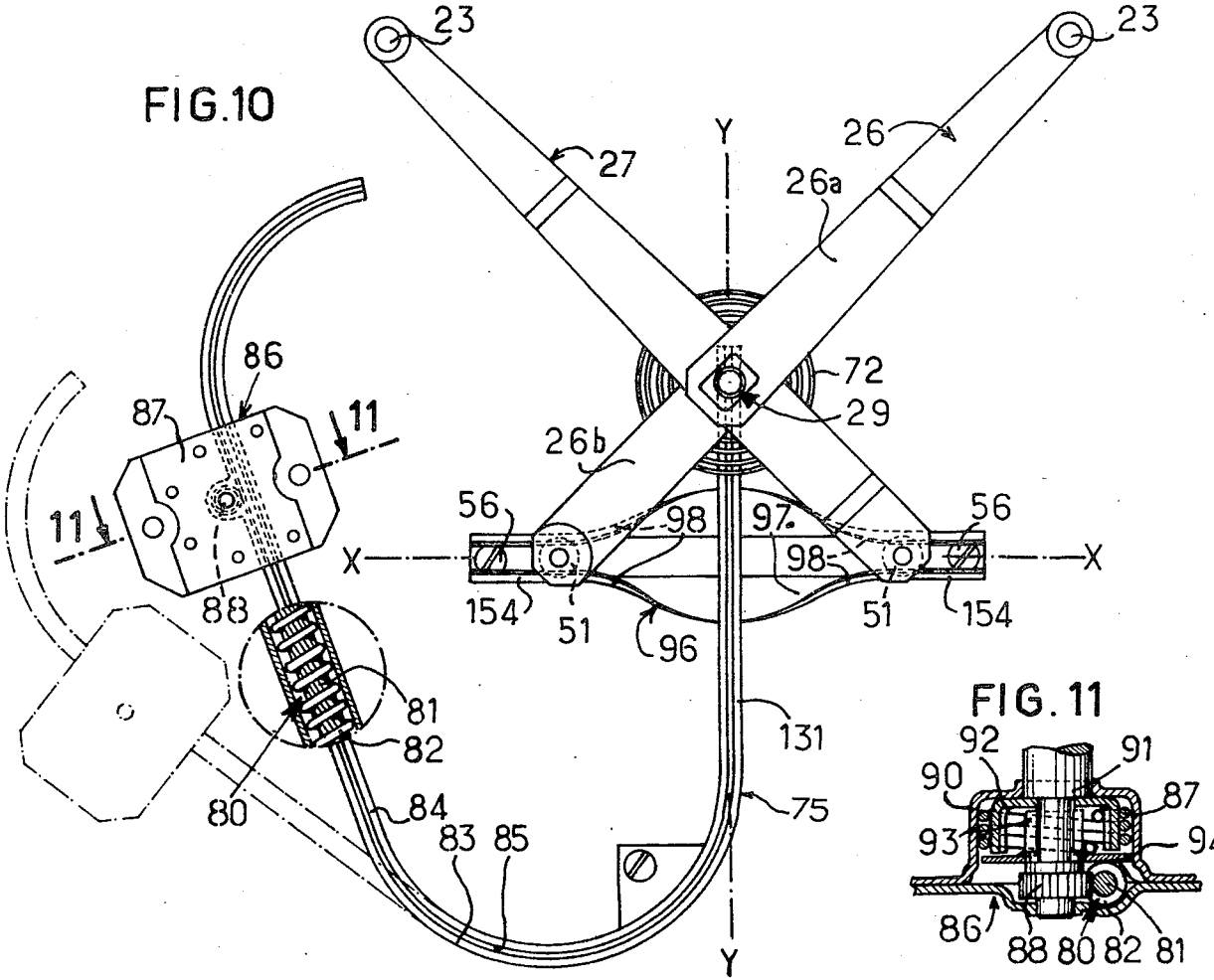
FIG. 10
FIG. 11

WINDOW RAISER

DESCRIPTION

The present invention relates to window raisers comprising two crossed arms of equal length disposed symmetrically relative to a roughly vertical axis, each of the arms being provided at one end with a member guided in a rectilinear slideway rigid with the base of the window, the arms having at their crossing point a common pivotal connection carried by a slide which is guided in a slideway whose axis coincides with the axis of symmetry of the two arms.

In French Pat. No. 1,264,086, which discloses such a window raiser, the two arms are, at the end thereof remote from the base of the window, pivotally mounted on fixed pins and the common pivot pin extends through oblong openings formed in the respective arms. Bearing in mind the raising travel which must be obtained, this known arrangement results in a relatively large vertical overall size and difficulties as concerns the positioning of the mechanisms in the box structure of some vehicle doors.

In order to overcome these drawbacks, the invention provides a window raiser of the aforementioned type, wherein, the end of each arm which is remote from the slideway at the base of the window carries a roller which is also guided in a fixed slideway whose axis is perpendicular to the vertical axis of the slideway and defines a centre line on each side of which the two arms are capable of moving.

For this purpose, preferably one of the arms is in a single piece whereas the other arm comprises two semi-arms located on each side of the first arm, the articulation common to the two arms being arranged in such manner as to ensure the rigid interconnection of the two semi-arms. This arrangement permits a considerable increase in the extent of the angular movements of the arms and consequently reduces the vertical overall size. It is then possible to equip any door with the proposed window raiser whose arrangement moreover permits the provision of the greatest thickness in the middle of the door panel where the curved shape of the door, if such a curved shape is provided, is maximum.

The adaptation of the arms to the possible curved shape of the window may be achieved by the flexibility of the arms an/or by the possibility given to the arms to undergo movements of limited extent in translation perpendicularly of the axis of the slideway.

The slide may be made to rise or descend in its slideway by known means, for example by a screw and nut mechanism whose nut is formed by the slide itself, in which case the rotation of the screw journalled in the slideway is advantageously achieved by means of an electric motor. It is also possible to construct the slideway guiding the slide in the form of a split tube containing a cable constituting a rack connected to the slide and to extend this tube along a suitable contour by passing it through an actuated mechanism comprising a gear pinion engaged with the cable and advantageously driven in rotation by a crank.

The two fixed centre slideways provided for guiding the end of the arms remote from the base of the window can be in one piece with the slideway guiding the slide and thereby constitute a single-piece member made for example from light alloy by a press operation or from a plastics material by a moulding operation. Another arrangement consists in constructing the two centre slideways in a single member whose centre part constitutes a planar surface the edges of which taper on each side of the axis of symmetry and are connected to the adjacent ends, which are divergent, of the slideways so as to constitute mouths which, when assembling the window raiser, facilitate the insertion of the corresponding guide rollers.

The invention will be explained merely by way of illustration in the course of the ensuing description with reference to the accompanying drawing in which:

FIG. 9 is an end elevational view similar to FIG. 1 of another embodiment of a window raiser having crossed arms;

FIG. 10 is a corresponding elevational view thereof;

FIG. 11 is a sectional view taken on line 11—11 of FIG. 10.

Figure 1:
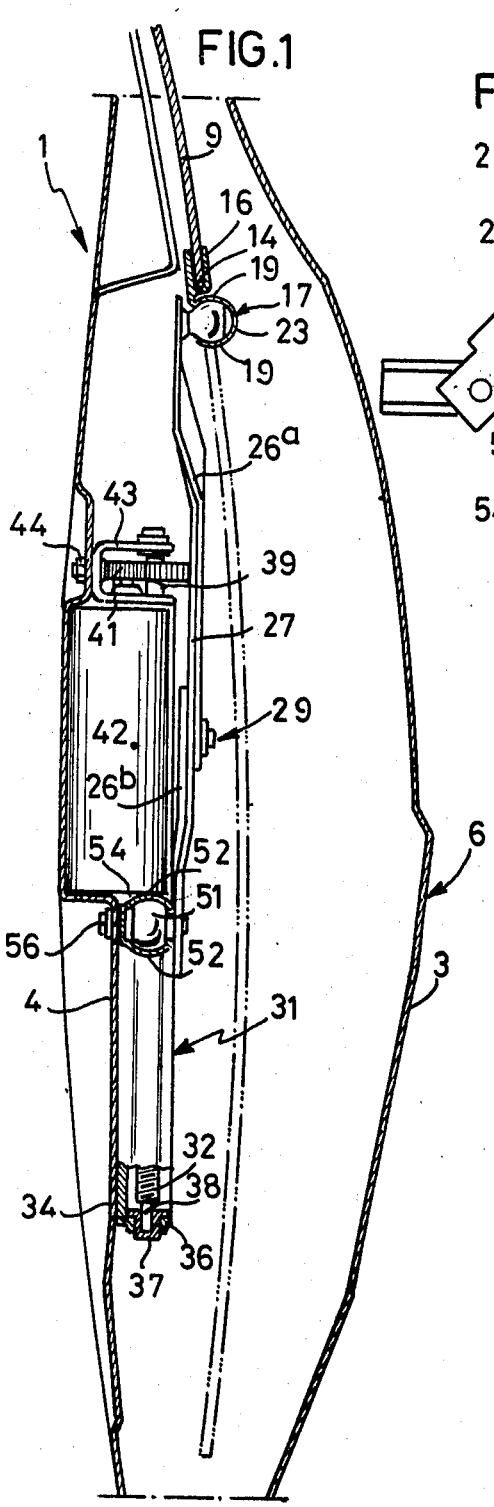
FIG. 1 is a vertical sectional view of a vehicle door equipped with a window raiser according to the invention.
Figure 2:
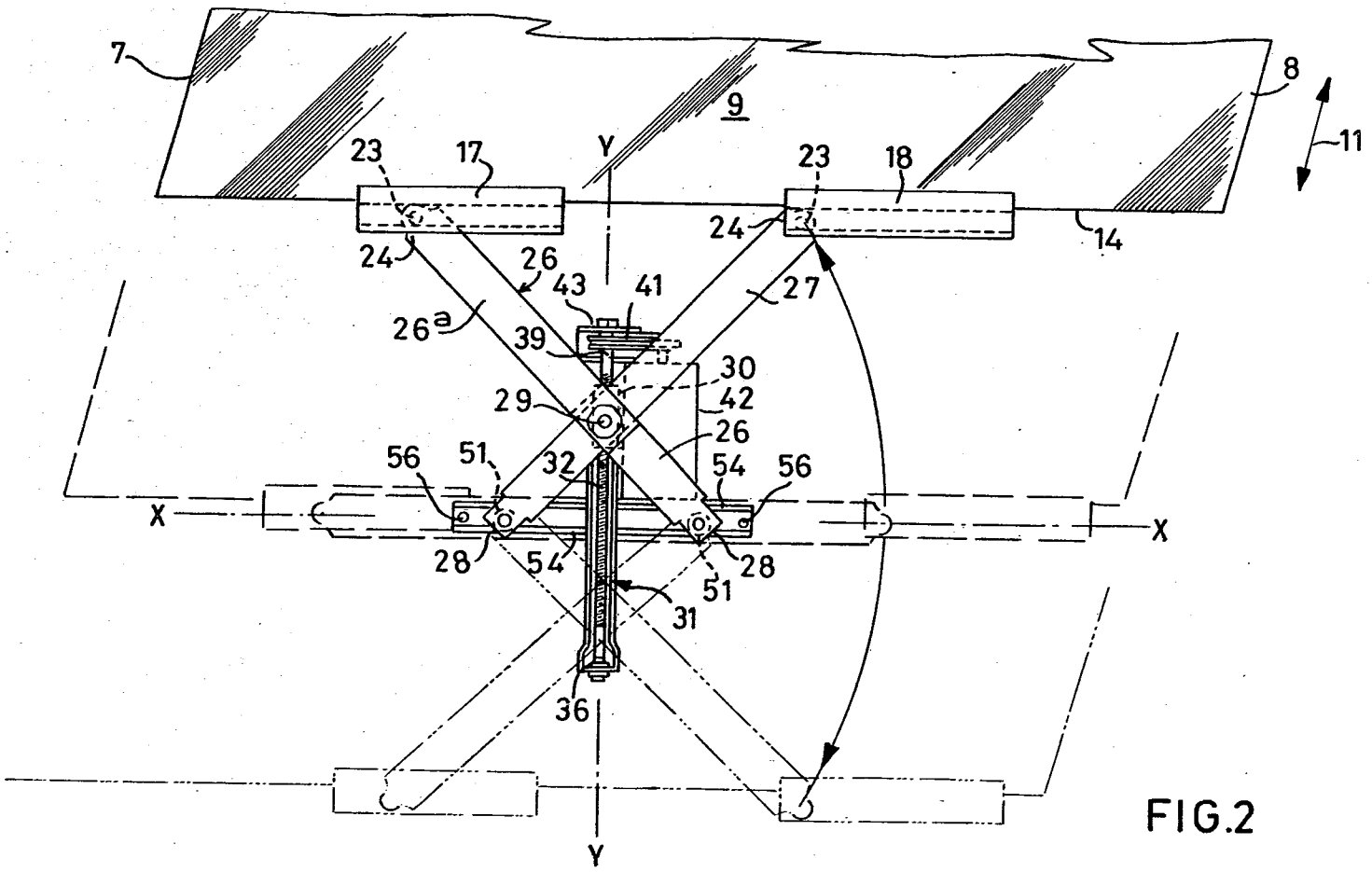
FIG. 2 is a diagrammatic elevational view of a window raiser comprising two symmetrical crossed arms.

The automobile vehicle door 1 shown in FIG. 1 has, in the conventional manner, a generaly curved shape defined in the lower half of the door by a bent outer panel 3 which is assembled with an inner panel 4 forming a box structure 6 provided with means (not shown) for guiding lateral edges 7, 8 of a window 9 in the direction of arrow 11 (FIG. 2).

The horizontal lower edge 14 of the window 9 is fitted and retained in a U-section member 16 on which are fixed two horizontal slideways 17, 18 which are spaced apart and disposed in longitudinal alignment with each other. These slideways have a U-section whose opening faces the inner panel 4. The sides 19 of each slideway 17, 18 have a concave curvature so as to retain and guide, in the respective slideways, two convex curved rollers 23 which are rotatively mounted on one of the ends 24 of two corresponding arms 26, 27 which are of equal length and are interconnected at a short distance from their other end 28, by an articulation 29 carried by a slide 30 guided in a vertical slideway and capable of being driven in translation by means of a rotary screw 32 which is engaged with a tapped hole 33 formed in the slide 30 which acts as a nut.

The slideway 31 is a U-section member which is open in the direction of the outer panel 3 and whose bottom 34 is fixed, for example by bolting, to the inner panel 4. The lower end of the slideway 31 has a transverse web 36 in which is fitted a cup 37 forming a radial and axial bearing for the end journal 38 of the screw 32 which further comprises an upper journal 39 on which is fixed a pulley which transmits to the screw 32, through a toothed belt 41, the torque produced by a reversible electric motor 42 which is suspended from a U-shaped member 43 fixed by bolts 44 to the inner panel 4, the upper branch of which member 43 acts as a radial bearing for the corresponding journal 39 of the screw 32.

The sides 46 of the U-section slideway 31 form ribs 47 which are engaged in sliding contact with corresponding grooves 48 of the slide 30 so that the forces applied by the arms 26, 27 are transmitted to the slideway 31 and not to the screw 32.

Figure 3:
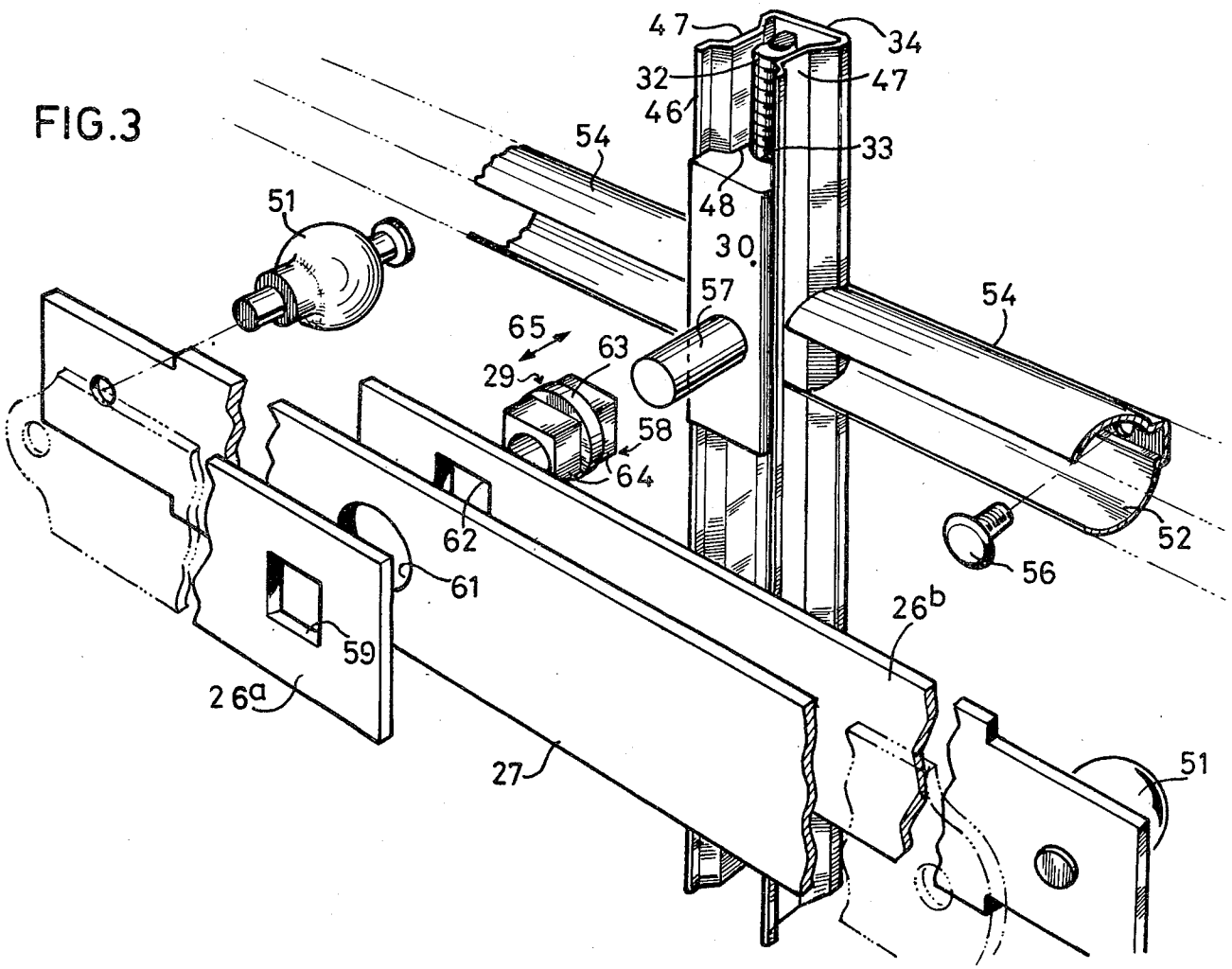
FIG. 3 is an exploded perspective view of the centre part of the window raiser showing the arms in their dead centre position.

At each of the ends 28 the crossed arms 26, 27 carry a roller 51 which has the same convex curved shape as one of two centre slideways 54 which are perpendicular to the screw 32, the U section of which is open in the direction of the outer panel 3. The slideways 54 are fixed by means of bolts 56 to the inner panel 4 on each side of the vertical slideway 31 with which they may form a single-piece member. The axis X—X common to the slideways 54 constitutes a horizontal centre line which the arms 26, 27 may pass through notwithstanding their crossed assembly, in the course of their angular movements under the effect of movement of the nut 30, owing to the fact that one of the arms, 26, is formed by two semi-arms *26a, 26b,* located on each side of the other arm, 27, which is in a single piece, these semi-arms being rendered rigid with each other owing to the special arrangement of the articulation 29 interconnecting the arms at their crossing point (FIG. 3).

This articulation 29 comprises, on the nut 30, a journal 57 which is slidably engaged in a sleeve 58 which extends through apertures 59, 61, 62 respectively formed in the semi-arm *26a,* the arm 27, and the semi-arm *26b.* The peripheral surface of this sleeve has a cylindrical portion 63 fitted in the aperture 61, which is of circular shape, of the arm 27 so as to allow relative rotation therebetween, and, on each side of this cylindrical portion, prismatic portions 64 which are engaged with the square contour of the apertures 59, 62 so as to ensure that the semi-arms *26a, 26b* rotate together by means of the keying effect.

The arms 26, 27 are symmetrical relative to the axis Y—Y of the screw 32 and they consequently make with the centre line X—X angles which are equal and in opposite directions.

In the embodiment just described, the arms 26, 27 form thin strips which render them flexible so that they are able to adapt themselves to the curvature of the window 9. It is also possible to employ, simultaneously, relatively rigid arms which are capable of undergoing small displacements in translation, as suggested by the arrow 65, along the journal 57 together with the sleeve 58.

Figure 4:
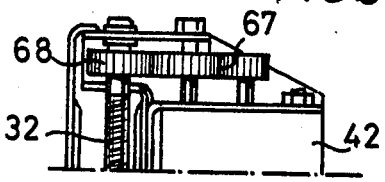
FIGS. 4 to 6 show modifications of the transmission device connecting the motor to the screw of the window raiser.
Figure 5:
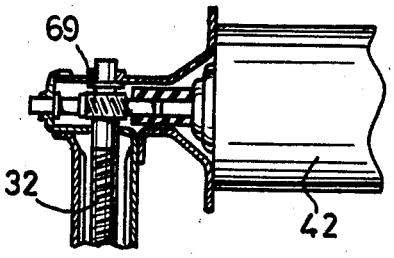
Figure 6:
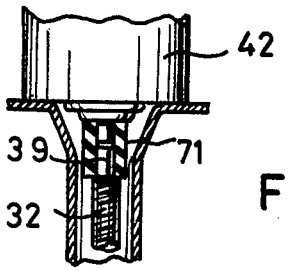

In FIGS. 4 to 6, the transmission between the motor 42 and the screw 32 is by means of respectively mutually engaged gear wheels 67, 68, a worm 69 and an associated worm-wheel, and an electrically yieldable coupling 71 which directly connects the upper journal 39 to the output shaft of the motor 42, instead of the previously-described toothed belt transmission.

Figure 7:
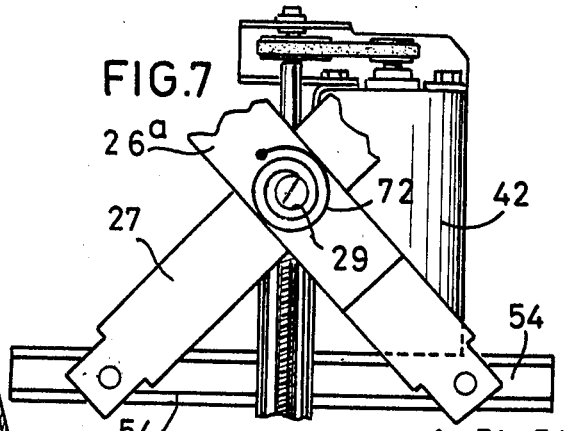
FIGS. 7 and 8 show two modifications employing compensation springs.
Figure 8:
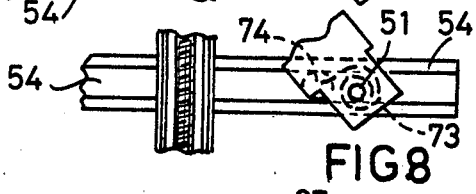

In the modification of FIG. 7, a spiral compensation spring 72 is mounted between the nut 30 and one of the arms so as to store energy during the descent travel and thereafter restore this energy during the upward travel. The ends of this spring 72 could also be hooked to the respective arms. In the embodiment of FIG. 8, two spiral compensation springs 73 are provided mounted around the spindles of the respective rollers 51 and each connected to an auxiliary roller 74 retained in the slideway 54.

In FIGS. 9 and 10, the vertical slideway 131 for guiding the slide 130 is part of a split tube 75 which contains and guides a control cable 80 constituting a rack, one of the ends of this cable being fixed to the slide 130. This cable comprises, in the known manner, a flexible core 81 formed by metal wires around which there is wound helically a wire 82 performing the function of a rack. The split tube extends beyond the zone 131 forming a slideway in a contour comprising a curvilinear portion 83 followed by a rectilinear portion 84 which extends obliquely upwardly in a vertical plane and extends through an actuating mechanism 86 whose case 87 contains a gear pinion 88 engaged with the rack-cable 80. The pinion 88 may be driven in rotation by a crank 89 fixed to a shaft 91 which is rigid, inside the case 87, with a fork member 92 which surrounds a braking spring 90 whose respective ends are engaged with a branch of the fork member and with a tab 93 of a guide plate 94 in a centre slot of which the pinion 88 is retained.

The journal 57 of the articulation 29 which is carried by the slide 130 projects through the slot 85 of the tube 75. The assembly of the journal and slide is, for example, of plastics material moulded on the cable 80.

The two centre slideways 154 provided for guiding the end of the arms 26, 27 remote from the base of the window, are formed in a single member 96 whose centre portion 97 forms a planar surface whose edges taper on each side of the axis Y—Y and are connected to the adjacent divergent ends 98 of the slideways 154, so as to form mouths whereby it is possible to insert in the slideways 154 in the open centre zone 97 the rollers 51 which are already mounted on the end of the arms 26, 27.

Like the slideway carrying member 96, the case 87 of the actuating mechanism and the guide sheath 131, 83, 84 are fixed to the inner panel 4 of the vehicle door (FIG. 1).

In FIG. 10, the dot-dash lines representing the portion 84 of the split tube and the actuating mechanism, illustrate the possibility of adaptation of the manually actuated window raiser of FIGS. 9 to 11, to the geometric shape of different doors.

Figure 12:
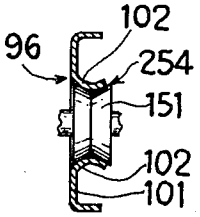
FIG. 12 is a sectional view of the centre slideway.

In the modification shown in FIG. 12, the slideway carrying member 96 mainly comprises a flat strip 101 in which each of the centre slideways 254 is produced by a double shaping operation on the strip, achieved by a blanking operation and a forming operation which form two flange portions 102 having a convex cross-sectional shape for guiding the corresponding roller 151 whose cross-sectional shape is concave.

Figure 13:
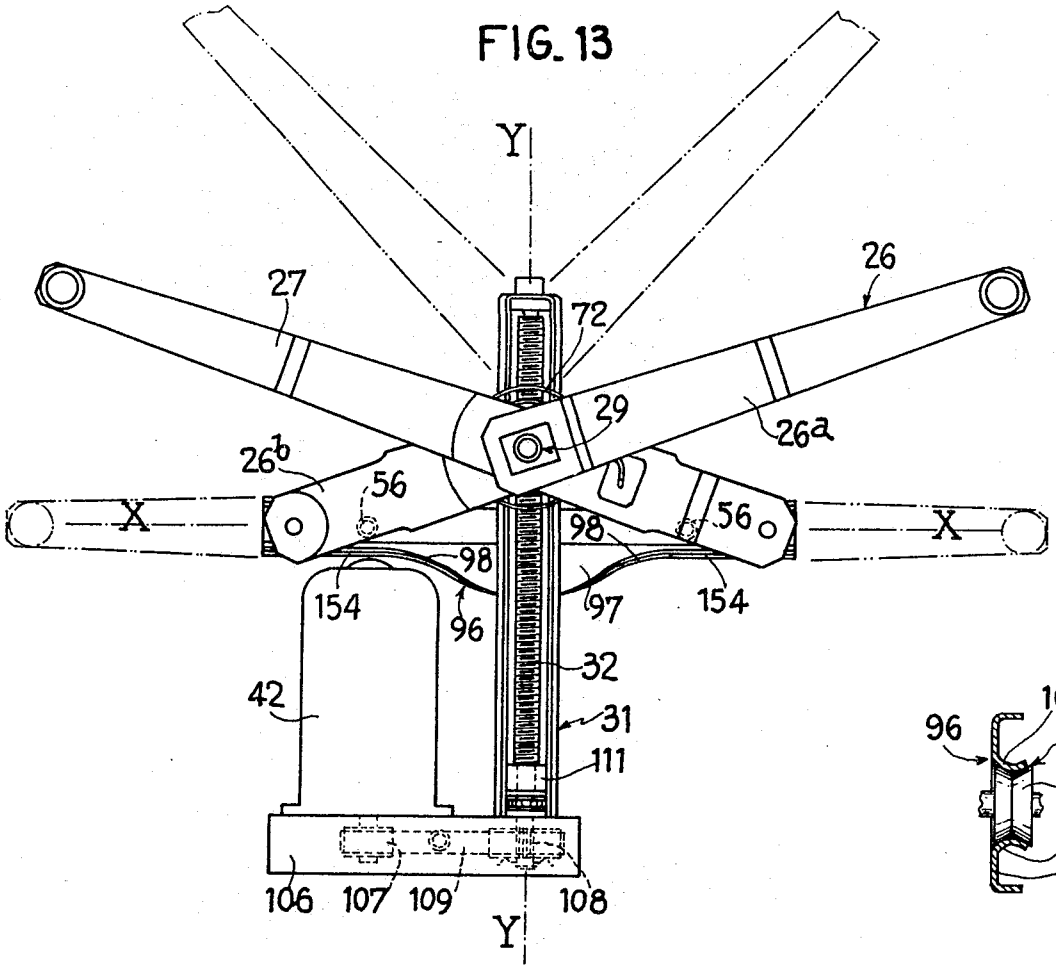
FIG. 13 is similar to FIG. 2 and shows a modification of the window raiser.

FIG. 13 shows a modification of the window raiser of FIG. 2 which is driven by an electric motor 42 through a screw-and-nut mechanism, in which the arms 26, 27 and the centre slideways 154 have the same arrangement as in FIG. 10. Further, the motor 42 is disposed in the vicinity of the lower end of the vertical slideway 31, immediately above a case 106 containing and protecting the toothed wheels 107, 108 and the toothed belt 109 which ensure the transmission of the drive to the bottom of the screw 32. In this modification, there is provided an end-of-travel stop 111 of an elastomer whereby the stoppage of the nut 30 in the lowermost portion occurs smoothly.

In the arrangement of FIGS. 9 and 10, the guide tube 75 could be split at 85 only in the region 131 where the slide 130 is guided. This region may be constructed in the form of a rigid section member having one end connected to a flexible tubular sheath which is connected to the actuating mechanism 86, if desired through a second rigid section member identical to the first-mentioned section member.

Likewise, the rack-forming part of the flexible cable could be provided solely in the region where this cable cooperates with the gear pinion 88 and be constructed in a way other than in the form of a core 81 surrounded by a helical wire 82, for example in the form of a rod to which a rack profile is imparted by a rolling operation, or a strip provided with equally-spaced transverse slots.

Having now described my invention what I claim as new and desire to secure by Letters patent is:

1. A window raiser comprising two crossed arms of equal length which are disposed symmetrically relative to a substantially vertical axis, each arm having at one end of the arm a member mounted thereon, a rectilinear slideway which is rigid with a base of the window being provided for each member and guidingly engaged with the member, a common articulation for the two arms at a crossing point of the arms, a slide carrying the articulation, a slideway having an axis coinciding with the axis of symmetry of the two arms and guidingly engaging the slide, a roller carried by an end of each arm which is remote from the corresponding slideway of the base of the window, and two fixed slideways respectively guidingly engaging the two rollers and having an axis which is perpendicular to the axis of the slide-guiding slideway and defines a centre line on each side of which centre line the two arms are capable of undergoing movements.

2. A window raiser as claimed in claim 1, wherein the arms are flexible.

3. A window raiser as claimed in claim 1, wherein the arms have freedom to move in translation to a limited extent in a direction perpendicular to the slide-guiding slideway.

4. A window raiser as claimed in claim 1, wherein a first of said arms is in a single piece whereas a second of said arms comprises two semi-arms located on each side of the first arm, the articulation common to the two arms being adapted and arranged to render the two semi-arms rigid with each other.

5. A window raiser as claimed in claim 4, wherein said common articulation comprises a cylindrical journal carried by the slide, a sleeve slidably mounted on the journal and comprising a cylindrical bearing portion and two portions which are on each side of said bearing portion and are connected to rotate with the respective semi-arms, the first arm having a circular aperture by which aperture the first arm is rotatively mounted on the cylindrical bearing portion.

6. A window raiser as claimed in any one of the claims 1 to 5, wherein the two fixed slideways are part of a single member having a centre portion which defines a planar surface and has edges on each side of the axis of symmetry, which edges are connected to adjacent divergent ends of the two fixed slideways so as to constitute mouths which facilitate the insertion of the corresponding guide rollers.

7. A window raiser as claimed in any one of the claims 1 to 5, wherein the two fixed slideways are part of a single member in the shape of a flat strip in which strip each of the fixed slideways is produced by a blanking and a forming of the strip which produce two flanged portions having a convex cross-sectional shape for the guiding of the corresponding roller whose cross-sectional shape is concave.

8. A window raiser as claimed in any one of the claims 1 to 5, wherein a spiral compensation spring is provided around the articulation of the two arms.

9. A window raiser as claimed in any one of the claims 1 to 5, comprising an elastically yieldable end-of-travel stop which is disposed at the lower end of the slide-guiding slideway.

10. A window raiser as claimed in any one of the claims 1 to 5, wherein the slide constitutes a nut and a screw rotatively mounted inside the slide-guiding slideway is screwthreadedly engaged with the nut and an electric motor is drivingly connected to the screw for rotating the screw.

11. A window raiser as claimed in claim 10, wherein the fixed slideways are in one piece with the slide-guiding slideway.

12. A window raiser as claimed in claim 10, wherein anti-rotation guide means are provided in the slide and in the slide-guiding slideway.

13. A window raiser as claimed in any one of the claims 1 to 5, wherein the slide-guiding slideway has the shape of a tube and a control cable is contained and guided in the tube, the cable having one end connected to the slide and at least a part of the length of the cable forming a rack, the window raiser further comprising an actuating mechanism, the tube extending into the actuating mechanism which comprises a gear pinion engaged with the part of the cable which forms a rack so as to drive the cable in either direction, the articulation common to the two arms projecting through the slot provided at least in the part of the tube which constitutes the slide-guiding slideway.

14. A window raiser as claimed in claim 13, comprising a braking spring incorporated in the actuating mechanism.

15. A window raiser as claimed in claim 13, wherein the split part of the tube which constitutes the slide-guiding slideway is a rigid section member having an end connected to a flexible tubular sheath which is connected to the actuating mechanism.

16. A window raiser as claimed in claim 15, wherein the respective ends of the flexible tubular sheath are connected to the rigid slide-guiding section member and to another rigid section member which is also in the shape of a split tube and extends through the actuating mechanism.

* * * * *